US006261063B1

(12) United States Patent
Chikami et al.

(10) Patent No.: US 6,261,063 B1
(45) Date of Patent: Jul. 17, 2001

(54) SEAL STRUCTURE BETWEEN GAS TURBINE DISCS

(75) Inventors: Rintaro Chikami; Kaoru Sakata; Takeshi Nakamura, all of Hyogo-ken (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/230,848

(22) PCT Filed: Jun. 3, 1998

(86) PCT No.: PCT/JP98/02455

§ 371 Date: Apr. 6, 1999

§ 102(e) Date: Apr. 6, 1999

(87) PCT Pub. No.: WO98/55736

PCT Pub. Date: Dec. 10, 1998

(30) Foreign Application Priority Data

Jun. 4, 1997 (JP) ..... 9-146475
Jun. 19, 1997 (JP) ..... 9-162647

(51) Int. Cl.[7] ..... F01D 5/30
(52) U.S. Cl. ..... 416/198 A
(58) Field of Search ..... 415/134, 135, 415/136, 137, 138, 139; 277/631, 632, 543, 547, 548; 416/198 R, 198 A, 95

(56) References Cited

U.S. PATENT DOCUMENTS

| | | | | |
|---|---|---|---|---|
| 499,266 | * | 6/1893 | Voorhees | 277/631 |
| 505,703 | * | 9/1893 | Dodge | 277/631 |
| 623,982 | * | 5/1899 | Chesterton | 277/631 |
| 669,047 | * | 2/1901 | Pratt | 277/631 |
| 747,448 | * | 12/1903 | Lomasney | 277/631 |
| 866,696 | * | 9/1907 | Taylor | 277/631 |
| 3,304,360 | * | 2/1967 | Hadley et al. . | |
| 3,642,295 | | 2/1972 | Cohen . | |
| 3,723,216 | * | 3/1973 | Kirkwood | 277/645 X |
| 3,761,102 | * | 9/1973 | Nicholson | 277/647 |
| 3,781,021 | * | 12/1973 | Thomson et al. | 277/631 |
| 4,063,845 | * | 12/1977 | Allen | 415/134 |
| 4,127,359 | | 11/1978 | Stephan . | |
| 4,218,067 | * | 8/1980 | Halling | 277/605 |
| 4,311,432 | * | 1/1982 | Kildea | 415/134 |
| 4,424,668 | | 1/1984 | Mukherjee . | |
| 4,477,086 | | 10/1984 | Feder et al. . | |

(List continued on next page.)

FOREIGN PATENT DOCUMENTS

| | | |
|---|---|---|
| 58-96105 | 6/1983 | (JP) . |
| 58-148236 | 10/1983 | (JP) . |
| 62-28959 | 2/1987 | (JP) . |
| 9-133005 | 5/1997 | (JP) . |
| 9-242505 | 9/1997 | (JP) . |

*Primary Examiner*—John Ryznic
(74) *Attorney, Agent, or Firm*—Sughrue, Mion, Zinn, Macpeak & Seas, PLLC

(57) ABSTRACT

In a steam cooling type gas turbine, a sealing structure for improving sealing performance between an interior of a rotor and a gas path of a turbine section which performs inter-disk sealing such that leakage of cooling steam and self-induced vibration of a baffle plate are prevented. A groove is formed along a circumferential direction in an end face of at least one of disk lands which protrude in opposition to each other between adjacent rotor disks, and an annular sealing member having an interior space is disposed in a sandwiched fashion, being brought into contact under pressure with an inner wall surface of the groove and an end face of the other disk land, or alternatively, an inner wall surface of a groove formed in the other disk land to thereby realize the inter-disk sealing structure for the gas turbine. Upon rotation of the turbine, sealing surface pressure is increased by centrifugal force to thereby reliably maintain sealing between the disks of the gas turbine, and the sealing performance in the gas turbine is improved.

5 Claims, 8 Drawing Sheets

U.S. PATENT DOCUMENTS

| | | | | |
|---|---|---|---|---|
| 4,537,024 | * | 8/1985 | Grosjean | 415/139 X |
| 4,602,795 | | 7/1986 | Lillibridge . | |
| 4,746,129 | * | 5/1988 | Puccio | 277/641 |
| 4,759,555 | | 7/1988 | Halling . | |
| 5,154,577 | * | 10/1992 | Kellock et al. | 415/134 X |
| 5,158,430 | * | 10/1992 | Dixon et al. | 415/134 |
| 5,167,485 | * | 12/1992 | Starkweather | 415/138 X |
| 5,221,096 | * | 6/1993 | Heldreth et al. | 415/175 X |
| 5,354,072 | * | 10/1994 | Nicholson | 277/647 |
| 5,531,457 | * | 7/1996 | Tibbott et al. | 415/139 X |
| 5,624,227 | * | 4/1997 | Farrell | 415/139 |
| 5,823,741 | * | 10/1998 | Predmore et al. | 415/134 |
| 5,975,844 | * | 11/1999 | Milazar et al. | 415/138 |
| 5,997,247 | * | 12/1999 | Arraitz et al. | 415/139 |

* cited by examiner

SEAL STRUCTURE BETWEEN GAS TURBINE DISCS

BACKGROUND OF THE INVENTION

1. Technical Field of the Invention

The present invention relates to a steam cooling type gas turbine which is adopted in a combined cycle power plant or the like, and more particularly to a sealing structure for sealing spaces between disks to prevent the leakage of cooling steam in the gas turbine.

2. Description of the Related Art

A combined cycle power plant is an electric power generating system in which a gas turbine plant and a steam turbine plant are combined, wherein the gas turbine is adapted to operate in a high temperature range of thermal energy and the steam turbine is employed in a low temperature range to recover and use thermal energy efficiently. This type of power generating system has been attracting attention in recent years.

In a combined cycle power plant such as mentioned above, the method of cooling the gas turbine of the topping cycle presents an important problem to be solved in the technical development of the combined cycle plant. As the result of trial-and-error attempts to realize a more effective cooling method there has been an evolution toward steam cooling systems, (also referred to as steam-jet cooling systems) in which steam obtained from the bottoming cycle is used as the coolant, and away from air-cooling systems in which compressed air is used as the coolant.

On the other hand, when the steam-jet cooling system is adopted, it is important to prevent the steam serving as the coolant from leaking along its path. To this end, many types of improvements in the sealing structure have been made.

A conventional sealing structure known heretofore will be described with reference to FIG. 9 and FIG. 10. The structure shown in these figures was first adopted in a gas turbine in which compressed air is employed as the coolant, and subsequently has been adopted in some steam cooling type gas turbines.

As is shown in FIG. 9, a rotor of a turbine section includes a plurality (ordinarily around four sets) of disks 1. In order to prevent a coolant 3 flowing through an inner space 2 of the rotor from flowing out to a gas path 4 of the turbine section while preventing a high-temperature gas 5 flowing through the gas path 4 of the turbine section from flowing into the inner space 2 of the rotor, annular projections (also referred to as disk lands) 6 are formed on the surfaces of adjacent disks 1 so as to face each other around a rotatable shaft, as shown in FIG. 10, wherein grooves 7 are formed in protruding end faces of the projections 6, respectively, so as to extend in a circumferential direction, and a seal plate (also referred to as a baffle plate) 8 divided into two or four parts in the circumferential direction in which the grooves 7 are disposed is inserted into the grooves 7. The baffle plate 8 is pressed against outer side walls of the grooves 7, respectively, by centrifugal force generated upon rotation of the turbine, whereby sealing is obtained.

With the conventional sealing structure described above, it is intended to realize the sealing by allowing the baffle plate to press against the outer side walls of the grooves formed in the arms of the disks under the action of the centrifugal force brought about by the rotation of the turbine. However, since the temperature differs from one disk to another, the elongation or stretch of the grooves in the radial direction will differ. Moreover, a difference can be observed among the disks with respect to the elongation in the radial direction under the influence of the centrifugal force.

On the other hand, since the baffle plate has a predetermined rigidity, a situation may arise where the baffle plate can not be pressed snugly and uniformly against the outer side walls of the grooves formed in the disks because of the difference in elongation, and as a result, minute gaps may be formed between the grooves and the baffle plates.

Consequently, the coolant confined within the interior of the rotor may flow to the gas path of the turbine section or the high-temperature gas may flow into the inner space from the gas path 4. Moreover, when the coolant continues to leak through the minute gaps, self-induced vibration of the baffle plate occurs causing abrasion of the baffle plate and other problems.

Thus, application of the sealing structure described above to the gas turbine where steam is used as the coolant, not to mention the case where compressed air is used as the coolant, will involve the loss of a large amount of steam from the bottoming cycle of an exhaust gas boiler or the like, causing a large degradation of the efficiency. Additionally, the amount of make-up steam will increase. For these reasons, the conventional sealing structure suffers serious problems concerning the validity of the system itself.

SUMMARY OF THE INVENTION

The present invention intends to solve the problems mentioned above in conjunction with the prior art and provide a sealing structure for a gas turbine which is capable of enhancing the sealing performance between the interior of a rotor and a gas path of a turbine section, and which thus contributes greatly to the practical applicability of the steam-jet cooling system.

The present invention has been made to achieve the object mentioned above and provides an inter-disk sealing structure for a gas turbine in which a plurality of rotor disks are disposed in juxtaposition with one another in the axial direction, wherein a groove extending in a circumferential direction is formed in an end face of at least one of two disk lands which protrude in opposition to each other between adjacent rotor disks, and wherein an annular sealing member having an interior space is disposed in a sandwiched fashion, being brought into contact under pressure with an inner wall surface of the groove and an end face of the other disk land, or alternatively, with an inner wall surface of a groove formed in the other disk land.

By virtue of the arrangement in which the annular sealing member having an interior space is adopted and in which the annular sealing member is disposed in a sandwiched fashion in a groove formed in a circumferential direction in an end face of at least one of disk lands which protrude in opposition to each other between adjacent rotor disks, being brought into contact under pressure with an inner wall surface of the groove and an end face of the other disk land, or alternatively, an inner wall surface of a groove formed in the other disk, inter-disk sealing in the gas turbine is reliably performed owing to the resiliency of the annular sealing member having the interior space and the sealing surface pressure which is increased by centrifugal force.

Further, the present invention provides an inter-disk sealing structure for a gas turbine, in which the annular sealing member formed of a tube which is hollow in cross section is constituted by interconnecting a plurality of segments in the direction of the annular elongation thereof.

By virtue of the structure of the annular sealing member constituted by interconnecting a plurality of segments in the direction of annular elongation, or in other words, in the circumferential direction to perform the inter-disk sealing in the gas turbine, the annular sealing member can stretch following the stretch or elongation of the rotor disks, which is thermally induced or occurs under the influence of centrifugal force, without being accompanied by stress in the circumferential direction due to centrifugal force, and a gap is not created in the seal portion. Thus, the sealing performance can be positively maintained regardless of the difference in elongation between the adjacent rotor disks.

Furthermore, according to the present invention, a sealing member having a generally M-shape cross-section may be adopted, wherein the sealing member mentioned above may be disposed in grooves formed in the end faces of the disk lands in a circumferential direction so that the sealing member can be brought into contact with the wall surfaces of the grooves extending in the radial direction of the rotor disks. Owing to the arrangement mentioned above, the sealing surface pressure can be increased under the influence of centrifugal force, and thus, the sealing performance can be reliably maintained regardless of the elongation or stretch of the rotor disk by properly selecting the contact points between the sealing member and the wall surface of the groove. Thus, the sealing performance of the gas turbine is improved.

Furthermore, by adopting a sealing member having a generally C-shape cross-section instead of the sealing member having the M-shape cross-section, substantially the same advantageous effects as those mentioned above can be obtained.

DESCRIPTION OF THE PREFERRED EMBODIMENTS

Figure 1:
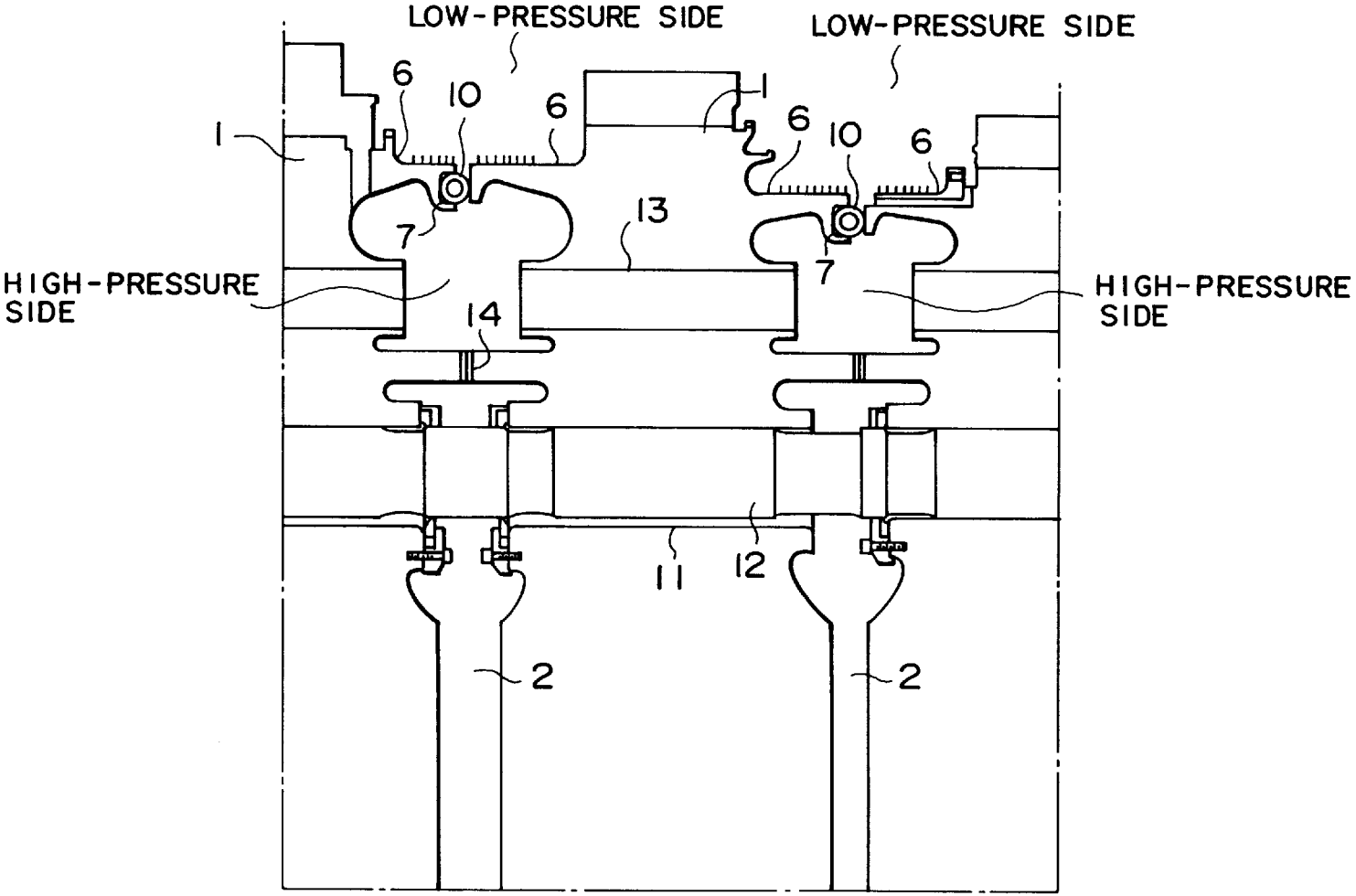
FIG. 1 is an explanatory view schematically showing an inter-disk sealing structure for a gas turbine according to an embodiment of the present invention.

A first embodiment of the present invention, i.e., a first preferred mode for carrying out the invention, will be described with reference to FIG. 1 to FIG. 5. Moreover, it should be mentioned that according to features of the invention incarnated in the instant embodiment, an annular sealing member formed of a tube which is hollow in cross section is employed in place of the baffle plate 8 used for sealing in the conventional sealing structure, and that another inventive feature can be seen with respect to the position at which the annular sealing member is to be disposed. With regard to the other parts or portions, the sealing structure according to the instant embodiment is substantially similar to the conventional one. Accordingly, illustration in the drawings is restricted to the substantive features of the invention, and parts or components similar to those in the previously described conventional gas turbine are denoted by like reference numerals, and repeated description thereof is omitted.

The sealing member 10 according to the instant embodiment is made of a hollow tube shaped in an annular form, as mentioned previously, and is disposed within a groove 7 formed in one of the disk lands 6 which project in opposition to each other between the adjacent disks 1.

The annular sealing member 10 is disposed so that the outer peripheral surface thereof bears on an inner wall surface of the groove 7 and an end face of the opposite disk land 6. Further, reference numeral 11 denotes bolt holes bored through the individual disks 1 (ordinarily around four disks are juxtaposed), and numeral 12 denotes a bolt which extends through the bolt holes 11 for interconnecting the individual disks 1 in an integral unit.

Reference numeral 13 denotes a steam hole which constitutes a passage for supplying the cooling steam. Further, reference numeral 14 denotes curvic couplings formed at tips of protruding portions of the adjacent disks 1, respectively, and which are meshed so as to prevent the center axes of the disks from deviating.

Figure 2:
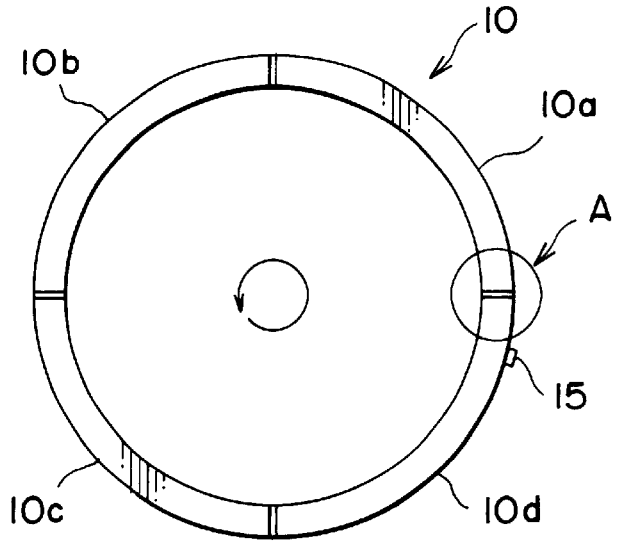
FIG. 2 is an explanatory view schematically showing the entire structure of a sealing member.

The aforementioned sealing member 10 is formed as an annular body by serially interconnecting four segments, i.e., a segment 10*a*, a segment 10*b*, a segment 10*c* and a segment 10*d*, wherein a rotation stopper key 15 is provided in a given one of these segments, as can be seen in FIG. 2.

Figure 3:
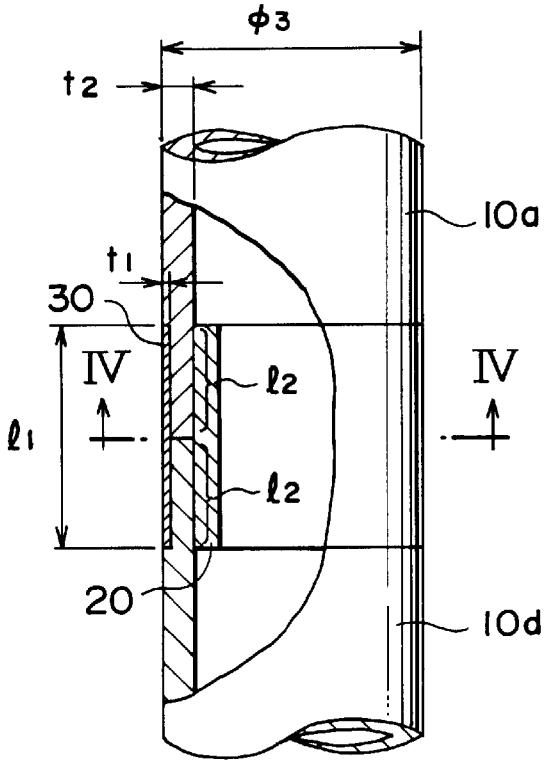
FIG. 3 is an explanatory view showing a portion A shown in FIG. 2 on an enlarged scale.
Figure 4:
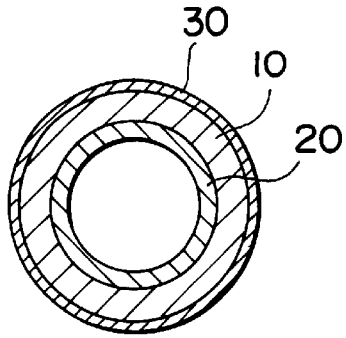
FIG. 4 is an explanatory view showing a cross section taken along line IV—IV in FIG. 3.
Figure 5:
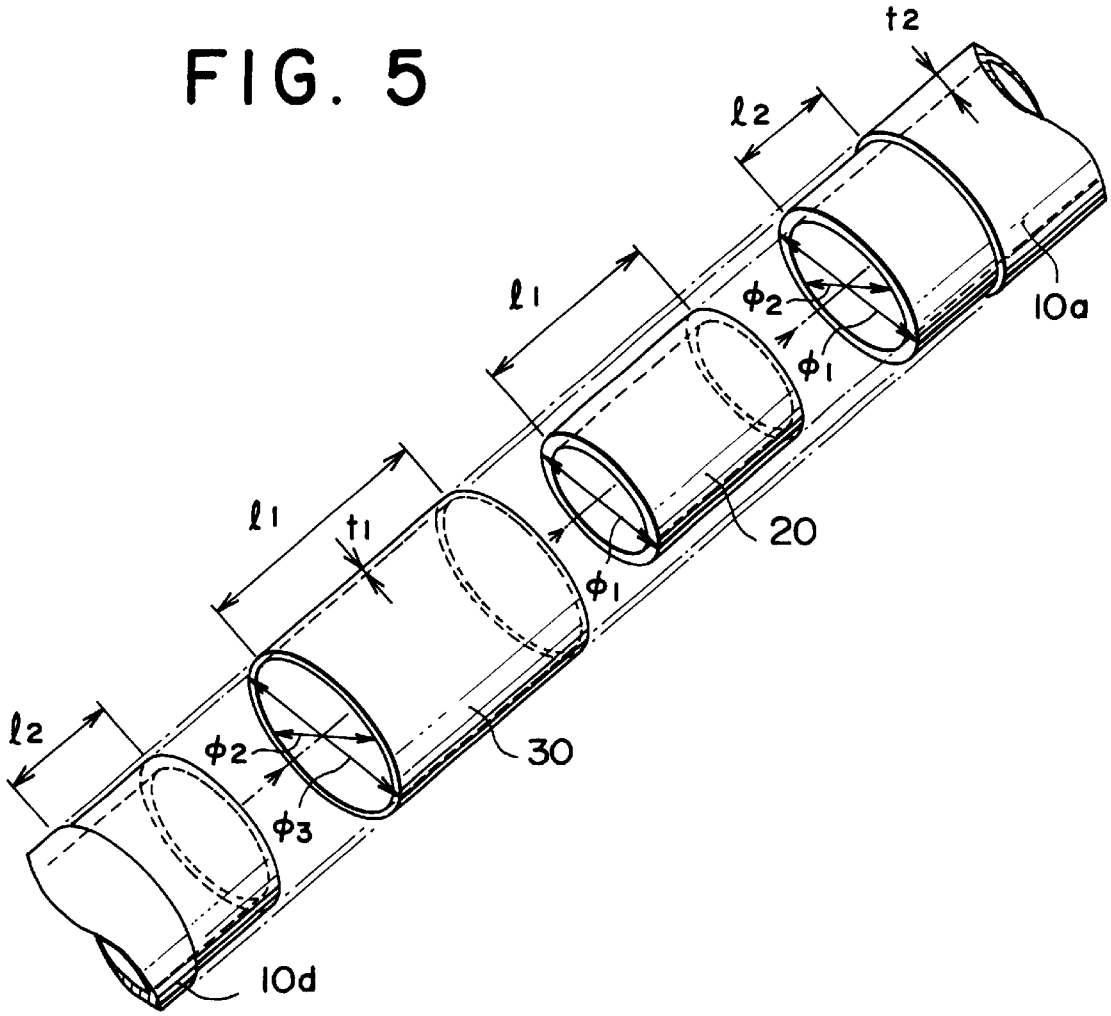
FIG. 5 is an explanatory view showing an assembly state of a joint portion of the sealing members.

Now, referring to FIG. 3 showing a portion A shown in FIG. 2 in detail, FIG. 4 showing a cross section taken along line IV—IV in FIG. 3, and FIG. 5 showing an assembly state of the individual parts, in which the joining state of the adjacent segments is illustrated by taking the segment 10*a* and the segment 10*d* as a representative example, it can be seen that an inner sleeve 20 is press-fitted inside each joint portion of the adjacent segments and that an outer sleeve 30 is fitted externally around joined end portions of the segments 10*a* and 10*d* at a position corresponding to the press-fit position of the inner sleeve 20, whereby these segments are coupled together.

Here, it is noted that the thickness of each of the joined end portions of the segment 10*a* and the segment 10*d* is previously decreased by an amount corresponding to the thickness of the outer sleeve 30. Accordingly, after the fitting of the outer sleeve 30, the outer diameter of the joint portion becomes equal to the outer diameter of the sealing member 10. In this manner, the sealing member 10 is formed as the annular member with a uniform thickness over the entire length.

With the sealing structure according to the instant embodiment realized as described above, the sealing member 10 can rotate together with the rotation of the rotor portion, whereby a centrifugal force is brought about under which the sealing member 10 is caused to positively bear on the previously mentioned inner wall surface of the groove 7 and the end face of the opposite disk land, whereby sealing can be performed between the adjacent disks 1. Accordingly, by increasing the weight of the sealing member 10, sealing surface pressure can be increased, whereby more positive sealing can be realized.

Furthermore, since the sealing member 10 is constituted by a plurality of segments 10*a* to 10*d* arrayed circumferentially as an annular body, stress in the circumferential direction due to the centrifugal force can be mitigated, while the sealing member 10 can follow the stretch or elongation of the disk 1 which is caused by heat and centrifugal force. Thus, gaps are not formed at the position of the sealing member. Additionally, the sealing performance of the sealing member is not affected by a difference in the elongation or stretch between the adjacent disks 1. Thus, the sealing can be reliably performed at the location where the sealing member is disposed.

By way of example, dimensional relationships at the joint portions of the segments 10*a* to 10*d* joined together may be selected with the values mentioned below.

The outer diameter of the inner sleeve 20 and the inner diameter of the segment 10*a*, . . . , 10*d* press-fitted into the inner sleeve 20, as represented by $\phi_1$, is 24 mm, the inner diameter of the outer sleeve 30 fitted at the position where the inner sleeve 20 has been inserted and the outer diameter of the segment 10*a*, . . . , 10*d* located at this position, as represented by $\phi_2$, is 31 mm, and the outer diameter of the outer sleeve 30, as represented by $\phi_3$, is 32 mm.

Further, the length of the outer sleeve 30 and the inner sleeve 20, as represented by $l_1$, is 30 mm, the length of the outer sleeve 30 and the inner sleeve 20 over which the outer sleeve and the inner sleeve are fitted into/onto the end portion of the each segment 10*a*, . . . , 10*d*, as represented by $l_2$, is 15 mm, the thickness of the outer sleeve 30, as represented by $t_1$, is 0.5 mm, and the total thickness inclusive of the outer sleeve 30 and the inner sleeve 20, as represented by $t_2$, is 3.5 mm.

In the foregoing, description has been made such that one of the disk lands 6 which face each other is provided with the groove 7, wherein the sealing member 10 is disposed between the groove 7 and the end face of the other disk land 6, as is shown in FIG. 1.

Figure 6:
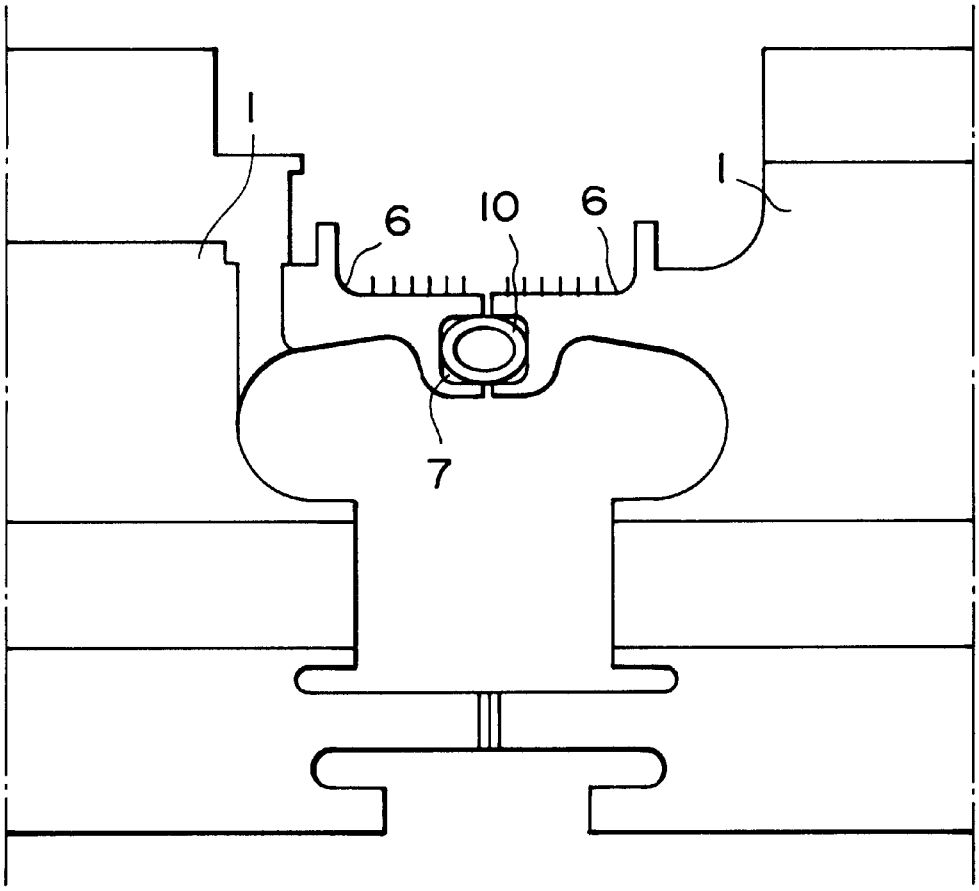
FIG. 6 is an explanatory view showing a partial modification of an essential portion of the sealing structure according to the instant embodiment.

However, arrangement may equally be adopted in which the disk lands 6, which face each other are formed symmetrically with respect to the joining surfaces, i.e., the grooves 7 are formed in both the facing disk lands 6, 6, respectively, wherein the sealing member 10 mentioned above may be disposed so that it bears on the inner wall surfaces of the grooves 7, respectively, as shown in FIG. 6.

Another embodiment of the present invention will be described with reference to FIG. 7. Here, it should first be mentioned that in the sealing structure according to the instant embodiment, an annular sealing member having a generally M-shape cross section is employed for sealing instead of the baffle plate 8 used in the conventional seal structure, wherein the annular sealing member is disposed at a particular position which will be described hereinafter. The other parts or portions are substantially the same as the corresponding ones of the conventional structure described hereinbefore. Accordingly, in the following, description of the conventional structure will be referred to, as occasion requires, and repetitive description will be omitted.

Figure 7:
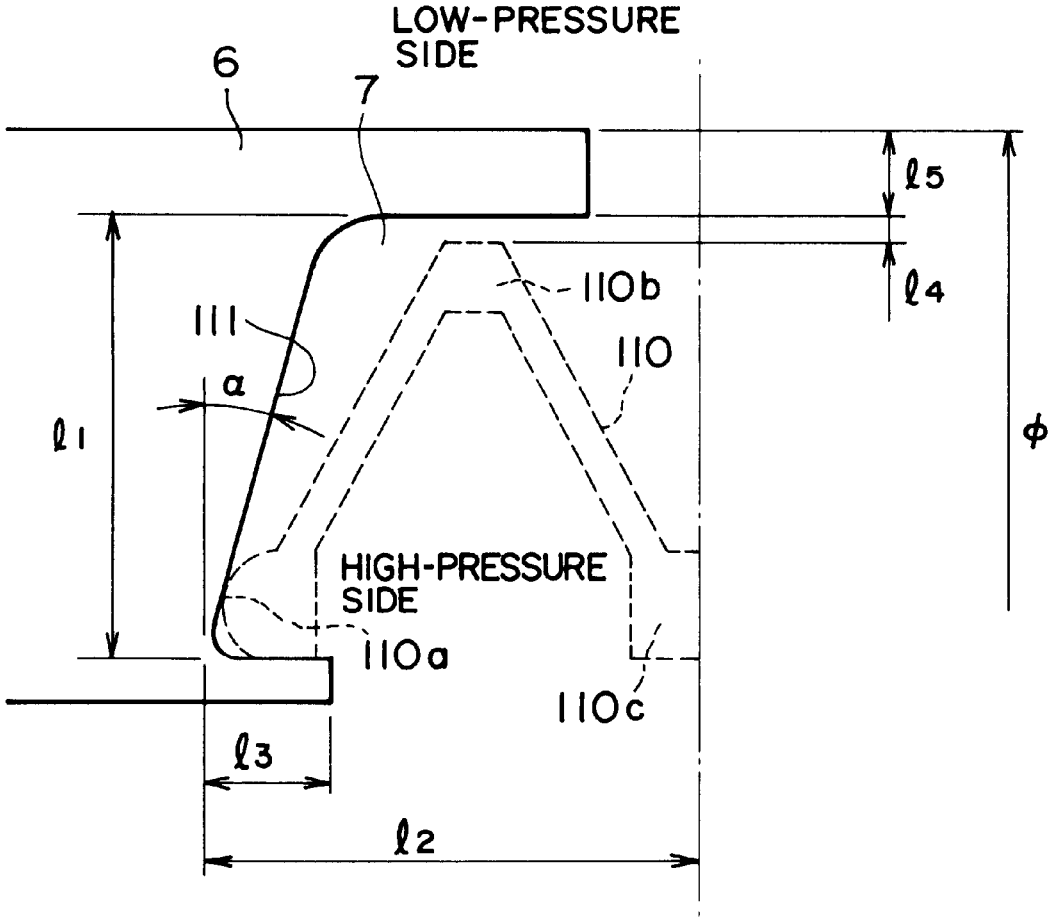
FIG. 7 is an explanatory view schematically showing an inter-disk sealing structure for a gas turbine according to another embodiment of the present invention.

In FIG. 7, only one of a pair of disks 1 disposed adjacent to each other is shown. Consequently, in FIG. 7, a sealing member 110 to be disposed between the paired disks 1 disposed oppositely adjacent to each other is divided into two halves at the center thereof and only one half is shown with the other being omitted from the illustration.

More specifically, at the other side relative to a center plane indicated by a broken line in the figure, an other half portion formed continuously with the member 110 shown at the one side is disposed in association with the other disk positioned in opposition to the aforementioned disk 1. Accordingly, the figure only shows half of the sealing member 110 which is intrinsically shaped like an M.

The sealing member 110 according to the instant embodiment is formed substantially as mentioned above and disposed in a sandwiched manner within grooves 7 which extend in the circumferential direction and which are formed in lower portions of the disk lands 6 protruding in opposition to each other between the adjacent disks 1.

The sealing member 110 formed in the M-like shape is positioned such that each of lower open ends 110*a* of the M-like sealing member bears on an oblique inner wall surface of the groove 7 while each of upper ends 110*b* of the M-like sealing member is positioned with a small gap relative to a lower surface of the disk land 6, whereas an intermediate portion 110*c* of the M-like sealing member is formed and positioned in a floating state within the space defined between the grooves 7.

With the sealing structure according to the instant embodiment, the sealing member 110 rotates together with the rotation of the rotor portion, whereby the sealing member is subjected to centrifugal force. Under the influence of the centrifugal force, each of the lower open ends 110*a* of the M-like sealing member is forced to bear on the oblique inner wall surface 111 of the aforementioned groove 7, whereby sealing is performed. Accordingly, by increasing the weight of the sealing member 110 itself, the sealing surface pressure can be increased.

Further, because the sealing points are defined at locations where each of the lower open ends 110*a* of the M-like sealing member 110 bear against the inner oblique wall surface 111 of each of the grooves 7 in which the sealing member 110 is disposed, the sealing performance can be sustained regardless of stretch or elongation of the disk 1 in the radial direction.

The sealing member 110 may be integrally formed as viewed in the circumferential direction. However, by forming the sealing member 110 with a plurality of segments divided in the circumferential direction, it is possible to mitigate stress which may be induced in the circumferential direction by centrifugal force.

Moreover, dimensional relationships among the M-like sealing members 110, the grooves 7 in which the sealing members are disposed and associated peripheral portions may be selected with, for example, values mentioned below.

In the overall structure in which the diameter measured at the top surface of the disk land 6 with reference to the center axis of the turbine, as represented by $\phi$, is 743 mm, the depth of the groove 7 (distance in the diametrical direction), as represented by $l_1$, is 24.5 mm, a half of the width (axial distance) of the groove 7, as represented by $l_2$, is 28.7 mm, the width of the lower open end of the sealing member 110, as represented by $l_3$, is 7.5 mm, the gap between the upper end 110*b* of the sealing member 110 and the lower surface of the disk land 6, as represented by $l_4$, is 1.5 mm, the thickness of the disk land 6, as represented by $l_5$, is 5 mm, and the angle of inclination of the oblique inner wall surface 111 of the groove 7 on which the lower open end 110*a* of the sealing member 110 is forced to bear, as represented by $\alpha$, is 15°. The sealing member 110 should desirably be made of a nickel-based alloy such as "Hastelloy X" or the like which can withstand oxidation by steam.

Figure 8:
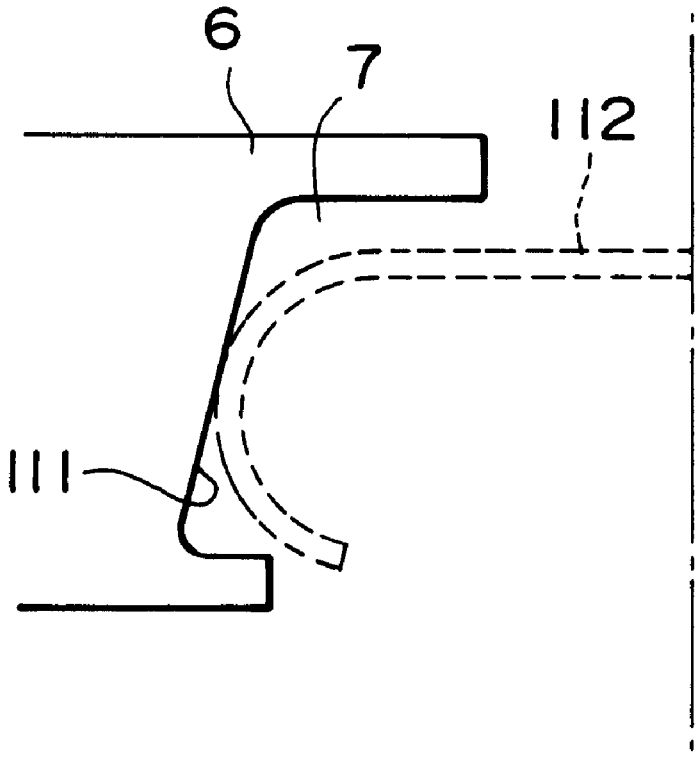
FIG. 8 is an explanatory view schematically showing a partial modification of the sealing member according to the instant embodiment.
Figure 9:
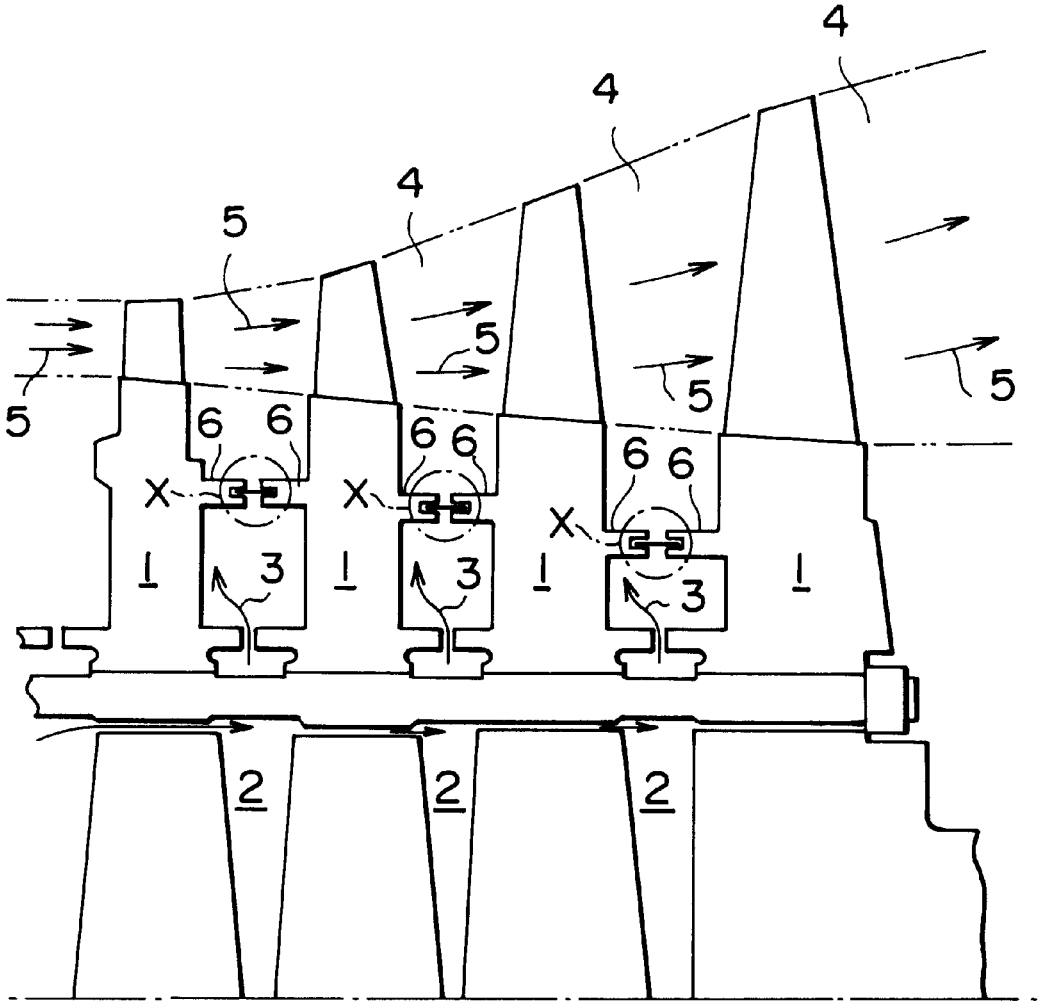
FIG. 9 is an explanatory view schematically showing a conventional inter-disk sealing structure in a gas turbine.
Figure 10:
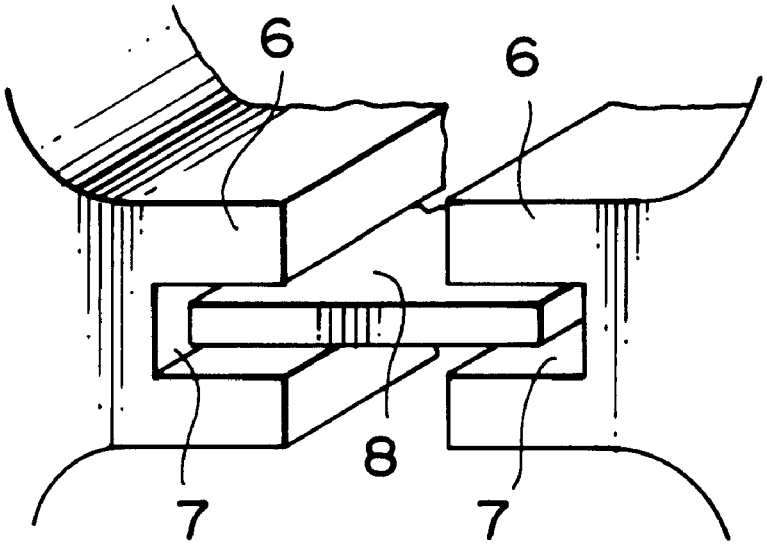
FIG. 10 is an explanatory view showing a portion X shown in FIG. 9 on an enlarged scale.

In the foregoing, it has been described that the sealing member 110 is formed in the M-like shape. However, it should be noted that a sealing member 112 with a generally C-shape such as shown in FIG. 8 may be employed and disposed such that upper and lower curved portions of the C-like sealing member 112 bear against an inner oblique wall surface 111 of the groove 7. In other words, the sealing member need not have exactly the M-like shape but may be formed with a shape similar to an M.

As is apparent from the foregoing description, by virtue of the arrangement according to the present invention in which the annular sealing member having a hollow cross section is adopted and in which the annular sealing member is disposed in a sandwiched fashion in a groove formed in a circumferential direction in an end face of at least one of disk lands which protrude in opposition to each other from adjacent rotor disks, being brought into contact under pressure with an inner wall surface of the groove and an end face of the other disk land, or alternatively, an inner wall surface of a groove formed in the other disk to thereby realize the inter-disk seal structure for the gas turbine, the inter-disk sealing in the gas turbine can be sustained with high reliability due to the sealing surface pressure which increases under centrifugal force upon rotation of the turbine, whereby the sealing performance can be enhanced, thus contributing greatly to the practical applicability of the steam-jet cooling system.

Furthermore, since the annular sealing member for realizing the inter-disk sealing in the gas turbine is constituted by continuously coupling a plurality of segments in the annular direction, i.e., in the circumferential direction, the sealing member can follow the stretch or elongation of the rotor disk, which is brought about by heat and the centrifugal force, without being accompanied by stress in the circumferential direction. Thus, gaps are not formed at the location of the sealing member. Furthermore, the sealing performance of the sealing member is not affected by differences in the elongation or stretch between adjacent rotor disks. Thus, the sealing performance can be reliably maintained, contributing greatly to the practical application of the steam-jet cooling system, as with the arrangement mentioned above.

Further, in the case where the sealing member of a generally M or C shape cross-section is employed, the sealing surface pressure can be increased under centrifugal force upon rotation of the turbine, whereby the sealing performance can be reliably maintained regardless of the stretch or elongation of the rotor disk in the radial direction by appropriately selecting or the contact points between the sealing member and the wall surface. Moreover, the sealing performance can be improved, which can thus make a great contribution to the practical applicability of the steam-jet cooling system.

In the foregoing, the present invention has been described in conjunction with the embodiments illustrated in the drawings. However, it goes without saying that the present invention is never restricted to these embodiments, but various modifications or changes may be carried out with respect to the concrete structures thereof without departing from the scope of the present invention.

What is claimed is:

1. An inter-disk sealing structure for a gas turbine having a plurality of rotor disks disposed in juxtaposition with one another in an axial direction, each of said plurality of rotor disks having respective disk lands opposing adjacent disk lands of other adjacent rotor disks of said plurality of rotor disks, said inter-disk sealing structure comprising:

a groove extending in a circumferential direction and formed in an end of at least one of two disk lands of said opposing adjacent disk lands of said plurality of rotor disks; and an annular sealing member having an interior space, is at least partially disposed in said groove in a manner that said annular sealing member is sandwiched between said opposing adjacent disk lands of said plurality of rotor disks and such that said annular sealing member seals a space between said opposing adjacent disk lands.

2. An inter-disk sealing structure for a gas turbine as set forth in claim 1, characterized in that said annular sealing member is constituted by a tube which is hollow in cross section.

3. An inter-disk sealing structure for a gas turbine as set forth in claim 2, characterized in that said annular sealing member is formed of a tube which is hollow in cross section is constituted by continuously interconnecting a plurality of segments in an annularly extending direction.

4. An inter-disk sealing structure for a gas turbine as set forth in claim 1, characterized in that said annular sealing member is a sealing member having a generally M-shape cross-section.

5. An inter-disk sealing structure for a gas turbine as set forth in claim 1, characterized in that said annular sealing member is a sealing member having a generally C-shape cross-section.

* * * * *